US006418632B1

(12) United States Patent
Kalfayan

(10) Patent No.: US 6,418,632 B1
(45) Date of Patent: Jul. 16, 2002

(54) PROJECTILE LAUNCHER SIGHT

(75) Inventor: Donald A. Kalfayan, Paradise, MI (US)

(73) Assignee: Apik Enterprises, Ltd., Paradise, MI (US)

( * ) Notice: Subject to any disclaimer, the term of this patent is extended or adjusted under 35 U.S.C. 154(b) by 0 days.

(21) Appl. No.: 09/186,320

(22) Filed: Nov. 4, 1998

Related U.S. Application Data

(60) Provisional application No. 60/064,576, filed on Nov. 4, 1997.

(51) Int. Cl.[7] ..... F41G 1/467
(52) U.S. Cl. ..... 33/265; 124/87
(58) Field of Search ..... 33/265, 391, 399, 33/398, 502; 124/87

(56) References Cited

U.S. PATENT DOCUMENTS

| | | | | | |
|---|---|---|---|---|---|
| 2,559,927 | A | | 7/1951 | Beloungy | 33/46 |
| 2,667,692 | A | | 2/1954 | Leafstrand | 33/46 |
| 2,669,023 | A | | 2/1954 | Pizzuti | 33/46 |
| 2,925,656 | A | | 2/1960 | Genovese | 33/46 |
| 2,982,026 | A | | 5/1961 | Peterson | 33/46 |
| 3,013,336 | A | | 12/1961 | Pennington | 33/46 |
| 3,058,221 | A | | 10/1962 | McNeel | 33/46 |
| 3,063,151 | A | | 11/1962 | Hanson | 33/46 |
| 3,271,863 | A | | 9/1966 | Harrington | 33/46 |
| 3,487,548 | A | | 1/1970 | Frydenlund | 33/46 |
| 3,521,362 | A | | 7/1970 | Duplechin | 33/46 |
| 3,568,323 | A | | 3/1971 | Lendway | 33/46 |
| 3,618,586 | A | * | 11/1971 | Current et al. | 124/87 |
| 3,718,979 | A | | 3/1973 | Allen | 33/265 |
| 3,787,984 | A | | 1/1974 | Bear et al. | 33/265 |
| 4,120,096 | A | | 10/1978 | Keller | 33/265 |
| 4,162,579 | A | | 7/1979 | James | 33/265 |
| 4,224,741 | A | | 9/1980 | Perry | 33/265 |
| 4,237,615 | A | | 12/1980 | Bracknell | 33/265 |
| 4,368,581 | A | | 1/1983 | Tullos | 33/265 |
| 4,417,403 | A | | 11/1983 | Strange | 33/265 |
| 4,418,479 | A | | 12/1983 | Stachnik | 33/265 |
| 4,532,717 | A | | 8/1985 | Watson et al. | 33/265 |
| 4,541,179 | A | | 9/1985 | Closson | 33/265 |
| 4,542,591 | A | * | 9/1985 | Montgomery | 33/265 |
| 4,580,349 | A | | 4/1986 | Webb et al. | 33/265 |
| 4,616,422 | A | | 10/1986 | Gaddy | 33/265 |
| 4,625,420 | A | | 12/1986 | Figured | 33/265 |
| 4,643,160 | A | | 2/1987 | Gray et al. | 124/87 |
| 4,711,036 | A | | 12/1987 | Morris | 33/265 |
| 4,720,919 | A | | 1/1988 | Saunders | 33/265 |
| 4,726,123 | A | | 2/1988 | Keller | 33/265 |

(List continued on next page.)

OTHER PUBLICATIONS

Winke, Bill, "Pendulum Bowsights", *Bowhunting*, Jan., 1997.

*Primary Examiner*—G. Bradley Bennett
(74) *Attorney, Agent, or Firm*—Kurt L. Van Voorhies

(57) ABSTRACT

A projectile launcher sight incorporates the combination of a pendulum sight subassembly together with a mechanism for adjusting the position of the pendulum sight subassembly relative to the projectile launcher. The pendulum sight subassembly provides for automatic range compensation, and the position adjusting mechanism provides a means for compensating for the elevation of the shooter relative to the target. This enables the pendulum sight assembly to be calibrated under relatively level shooting conditions, and then used with accuracy under conditions where the elevation of the shooter differs from that of the target. The position adjusting mechanism is provided with an indexing mechanism for setting the position to one of a plurality of precalibrated positions so that the elevation adjustment can be readily made under low light conditions or while wearing gloves. The projectile launcher sight is particularly suited for application as an archery bow sight.

28 Claims, 3 Drawing Sheets

U.S. PATENT DOCUMENTS

| | | | | |
|---|---|---|---|---|
| 4,794,702 | A | 1/1989 | Martin | 33/265 |
| 4,894,921 | A | 1/1990 | Barlow | 33/265 |
| 4,961,265 | A | 10/1990 | Roberts | 33/265 |
| 4,974,328 | A | 12/1990 | Lowry | 33/265 |
| 5,001,837 | A | 3/1991 | Bray | 33/265 |
| 5,040,300 | A | 8/1991 | Sheffield | 33/265 |
| 5,048,193 | A | 9/1991 | Hacquet | 33/265 |
| 5,092,052 | A | 3/1992 | Godsey | 33/265 |
| 5,092,053 | A | 3/1992 | Roberts | 33/265 |
| 5,121,547 | A | 6/1992 | Littlejohn | 33/265 |
| 5,127,166 | A | 7/1992 | Bishop | 33/265 |
| 5,253,423 | A | 10/1993 | Sullivan, Jr. et al. | 33/265 |
| 5,305,530 | A | 4/1994 | Robertson, Jr. et al. | 33/265 |
| 5,347,722 | A | 9/1994 | Sefsick | 33/265 |
| 5,359,780 | A | 11/1994 | Dallaire | 33/265 |
| 5,388,336 | A | 2/1995 | Pomaville | 33/265 |
| 5,419,051 | A | 5/1995 | Barngrover | 33/265 |
| 5,454,169 | A | 10/1995 | Keller | 33/265 |
| 5,465,491 | A | 11/1995 | Thell | 33/265 |
| 5,524,601 | A | 6/1996 | Slates et al. | 124/87 |
| 5,539,989 | A | 7/1996 | Potter | 33/265 |
| 5,561,910 | A | 10/1996 | Maynard | 33/265 |

* cited by examiner

PROJECTILE LAUNCHER SIGHT

CROSS-REFERENCE TO RELATED APPLICATIONS

The instant application claims the benefit of prior U.S. Provisional Application Serial No. 60/064,576 filed on Nov. 4, 1997.

TECHNICAL ART

The instant invention generally relates to projectile launcher sights which compensate for both the range to the target and the elevation of the shooter relative to the target. More particularly, the instant invention relates to sights for those projectile launchers such as archery bows for which such compensation is necessary.

BACKGROUND OF THE INVENTION

A projectile launcher launches a projectile at a target at which the shooter aims using a sight. The projectile launched by the projectile launcher follows a ballistic trajectory towards the target, which trajectory is influenced by forces of gravity and drag. The projectile launcher must accordingly be aimed so as to cause the projectile to be launched on a trajectory intersecting the target. The degree to which the initial direction of the projectile differs from the associated straight line path to the target is dependent upon the distance to the target and the degree of influence of gravity or drag upon the projectile, whereby this difference is greater for projectiles launched at relatively lower velocities or which have relatively higher amounts of drag. For example, archery bows, cross bows, sling shots, and low power rifles, such as air rifles, are all subject to significant influences of gravity and drag upon the trajectory of their associated projectiles.

The purpose of the sight on the projectile launcher is to enable the shooter to align the projectile launcher by aiming the sight on the target so as to cause the trajectory of the projectile to intersect the target. For example, when an arrow is shot from an archery bow the departure of the trajectory of the arrow from a straight line can be significant, particularly for distant targets, which requires a means in the associated bow sight to compensate for target range. The departure of the arrow trajectory from a straight line generally depends upon the range to the target and the elevation of the archer relative to that of the target.

More particularly, in the field of archery, an elementary bow sight comprises a single fixed pin, whereby the archer aims the bow by aligning the pin with the target. By maintaining a consistent draw of the bow and a consistent placement of the knock of the drawn arrow relative to the archer's eye the trajectories of similarly aimed shots can be made consistent. The problem with a single fixed pin however is that the sight will be properly aimed for only one mode of operation of the bow, i.e. for a limited range of target ranges and a limited range of shooting elevations relative to the target elevation.

The prior art teaches a bow sight assembly comprising a plurality of fixed pin sights, each of which is calibrated for a different target range, or combination of target range and shooting elevation relative to the target elevation. However, one disadvantage of such a sight assembly is that each of the fixed pins must be separately calibrated. Furthermore, there is a potential for the archer to use the wrong pin for aiming at the target.

The prior art also teaches a bow sight assembly comprising a mechanism for adjusting the position of either a single pin sight, or a multiple pin sight assembly, or a cross-hair attached at a sight attachment point, in accordance with the range to the target. This type of sight also has the disadvantage of needing to be calibrated for each of the various modes of operation of the bow. Furthermore, the associated mechanism can be expensive and difficult to produce, and difficult to operate properly under conditions of low ambient lighting or when wearing gloves. Examples of this type of sight are disclosed in U.S. Pat. Nos. 2,669,023, 3,487,548, 3,568,323, 3,718,979, 3,787,984, 4,162,579, 4,224,741, 4,368,581, 4,532,717, 4,541,179, 4,643,160, 4,726,123, 5,001,837, 5,092,052, 5,359,780, 5,419,051, 5,465,491 and 5,524,601. While these patents teach various mechanisms for adjusting the height of a sight attachment point, none of these patents teach or suggest the incorporation of a pendulum sight subassembly at the sight attachment point.

The prior art also teaches the use of a combination of front and rear sights, or a telescope having a sighting axis, so as to improve shooting accuracy. However, these sights also require a means for adjustment and calibration to accommodate different ranges and elevations of the archer relative to the target. Examples of this type of sight are disclosed in U.S. Pat. Nos. 2,559,927, 2,667,692, 2,982,026, 3,058,221, 3,063,151, 3,271,863, 4,237,615, 4,417,403, 4,418,479, 4,625,420, 4,961,265, 5,040,300, 5,048,193, 5,092,053 and 5,539,989. While these patents teach various mechanisms for adjusting the orientation of either a combination front and rear sights, or a telescope having a sighting axis, none of these patents teach or suggest the incorporation of a pendulum sight subassembly with such mechanisms.

Another type of archery bow sight taught in the prior art, and in common use, is referred as a pendulum bow sight, which comprises a pendulum having center of gravity and a pivot point located thereabove. The pendulum pivots about one end of a pivot shaft which axis passes through the pivot point, and the other end of the pivot shaft is secured to the archery bow at the sight attachment point. The pendulum is biased so that the center of gravity of the pendulum remains directly below the pendulum pivot point—the pendulum stays in a vertical position—regardless of the elevation angle of the archery bow. A sight aiming point is attached to or incorporated on the pendulum. In some commercially available pendulum bow sights, the pendulum is constructed from a rod which incorporates the sight aiming point at the upper end. The pendulum is further provided with a counterweight, a means for adjusting the relative length of the pendulum above the pivot point, and a means for adjusting the position of the counterweight along the lower length portion of the pendulum. In operation, for a target elevation which differs from the elevation of the archer's eye, the angle of the ray projected from the archer's eye to the target changes with the range of the target relative to the archer. Therefore, targets of differing ranges cause the archer to incline the bow at correspondingly different angles in order to align the bow sight with the target. The pendulum remains vertical independent of the elevation angle of the archer's bow, so that the position of the sight aiming point changes relative to the projectile launcher. More particularly for a target below the eye level of the archer, as the target range is increased, the archer must raise the bow in elevation angle to keep the sight aiming point aligned with the target. As the elevation angle of the bow is increased, an associated automatic rotation of the pendulum causes the projected distance between the sight aiming point and the arrow to decrease, which thereby causes the archer to raise the bow in elevation angle more that would have been raised had the sight aiming point been fixed. Therefore, the pendulum sight inherently provides compensation for target range so as to enable the archer to shoot accurately over a range of target ranges. The pendulum bow sight is particularly useful for automatically compensating for target range when shooting from elevated platforms. However, a pendulum bow sight calibrated for shooting from an elevated platform, such as a tree stand, will not be calibrated for shooting from ground level. More particularly, the pendulum bow sight must be calibrated for the conditions of relative elevation between target and shooter under which the sight will be used.

Examples of pendulum bow sights are disclosed in U.S. Pat. Nos. 2,925,656, 3,013,336, 3,521,362, 4,120,096, 4,580,349, 4,616,422, 4,711,036, 4,720,919, 4,794,702, 4,894,921, 4,974,328, 5,121,547, 5,253,423, 5,305,530, 5,347,722 and 5,561,910. While these patents teach various pendulum bow sight assemblies, and disclose a means for adjusting the height of the pendulum sight assembly for calibration thereof, whereby otherwise the height of the pendulum sight assembly remains fixed during operation of the pendulum sight, none of these patents teach or suggest the incorporation of a mechanism for quickly adjusting the height of the pendulum sight assembly during operational conditions, in accordance with a predetermined calibration, so as to accommodate variations in the elevation of the shooter relative to the target.

SUMMARY OF THE INVENTION

The instant invention overcomes the above-noted problems by providing an improved sight comprising the combination of a pendulum sight subassembly together with a mechanism for adjusting the position of the pendulum sight subassembly relative to the projectile launcher. The pendulum sight subassembly provides for automatic range compensation, and the position adjusting mechanism provides a means for compensating for the elevation of the shooter relative to the target. This enables the pendulum sight assembly to be calibrated under relatively level shooting conditions, and then used with accuracy under conditions where the elevation of the shooter differs from that of the target. The position adjusting mechanism is provided with an indexing mechanism for setting the position to one of a plurality of precalibrated positions so that the elevation adjustment can be readily made under low light conditions or while wearing gloves.

Accordingly, one object of the instant invention is to provide an improved sight for a projectile launcher which is accurate over a wide range of operating conditions using a single calibration.

A further object of the instant invention is to provide an improved sight for a projectile launcher which automatically compensates for the range of the target.

A yet further object of the instant invention is to provide an improved sight for a projectile launcher which is readily and quickly adjustable to account for the elevation of the shooter relative to the target.

A yet further object of the instant invention is to provide an improved sight for a projectile launcher which can be calibrated with targets at the same elevation at the shooter, and then used with accuracy when shooting from elevations which are relatively different from that of the target.

A yet further object of the instant invention is to provide an improved sight for a projectile launcher which is relatively rugged and which resists both bending and twisting deformations.

A yet further object of the instant invention is to provide an improved sight for a projectile launcher which is mountable on the lateral side surface of a bow riser.

A yet further object of the instant invention is to provide an improved sight for a projectile launcher which can be incorporated directly on the lateral side surface of the bow riser.

A yet further object of the instant invention is to provide an improved sight for a projectile launcher which can be protected from damage or disturbance by sight guard.

A yet further object of the instant invention is to provide an improved sight for a projectile launcher which may be used under conditions of low ambient lighting.

A yet further object of the instant invention is to provide an improved sight for a projectile launcher which may be readily adjusted while wearing gloves.

A yet further object of the instant invention is to provide an improved sight for a projectile launcher which is inexpensive to produce.

A yet further object of the instant invention is to provide an improved sight for a projectile launcher which is robust.

A yet further object of the instant invention is to provide an improved sight for a projectile launcher which can be used for either hunting or target shooting.

In accordance with these objectives, one feature of the instant invention is the incorporation of a conventional pendulum sight subassembly.

Another feature of the instant invention is the incorporation of a means for translating the pivot point of the pendulum sight subassembly to account for the elevation of the projectile launcher relative to the target.

Yet another feature of the instant invention is the incorporation of a calibrated means for translating the pivot point of the pendulum sight subassembly to account for the elevation of the projectile launcher relative to the target.

Yet another feature of the instant invention is the incorporation of an indexing mechanism in the means for translating the pivot point of the pendulum sight subassembly.

Yet another feature of the instant invention is the incorporation of a rotatable plate to which the pendulum sight subassembly is attached as the means for translating the pivot point of the pendulum sight subassembly.

The specific features of the instant invention provide a number of associated advantages. One advantage of the instant invention with respect to the prior art is that the pendulum sight subassembly provides for automatic compensation for target range.

Another advantage of the instant invention is that the means for translating the pivot point of the pendulum sight subassembly provides for compensation for the elevation of the shooter relative to the target.

Yet another advantage of the instant invention is that the indexing mechanism in the means for translating the pivot point of the pendulum sight subassembly enables ready and quick adjustment of the sight to compensate for the elevation of the shooter relative to the target, even under conditions of relatively low ambient lighting, or if the shooter is wearing gloves.

Yet another advantage of the instant invention is that the embodiment thereof can be compact, rugged, readily adapted to or incorporated on the lateral side surface of the bow riser, and amenable to protection by a sight guard.

Yet another advantage of the instant invention is that the embodiment thereof can be readily and inexpensively produced.

Yet another advantage of the instant invention is that by the incorporation of a pendulum sight subassembly to provide automatic range compensation together with the means to translate the pivot point of the pendulum sight subassembly to account for the elevation of the projectile launcher relative to the target, the instant invention is robust and can be used for either hunting or target shooting under a wide variety of operating conditions.

Accordingly, the instant invention provides for an improved sight for a projectile launcher which provides automatic compensation for target range, and manual compensation for the elevation of the shooter relative to the target in accordance with a predetermined calibration, whereby the sight may be calibrated at ground level and then used with accuracy over a range of shooter elevations relative to the target. The instant invention provides for an improved sight which is rugged and which is amenable to protection by a sight guard. The instant invention can be operated under conditions of low ambient lighting, or while wearing gloves. The instant invention is easy to produce, and can be embodied as either an attachment to an existing archery bow, or incorporated into the bow. The instant invention utilizes a conventional pendulum bow sight—which is commercially available—as a subassembly.

These and other objects, features, and advantages of the instant invention will be more fully understood after reading the following detailed description of the preferred embodiment with reference to the accompanying drawings. While the description herein illustrates the application of the instant invention to the field of archery, one of one of ordinary skill in the art will appreciate that the instant invention can most generally be used as a sight assembly for any projectile launcher, particularly those such as bows, cross bows, sling shots, and air rifles for which the projectile velocity is relatively low whereby the associated projectile trajectory is significantly influenced by the forces of gravity or drag.

DETAILED DESCRIPTION OF THE PREFERRED EMBODIMENT(S)

Figure 1:
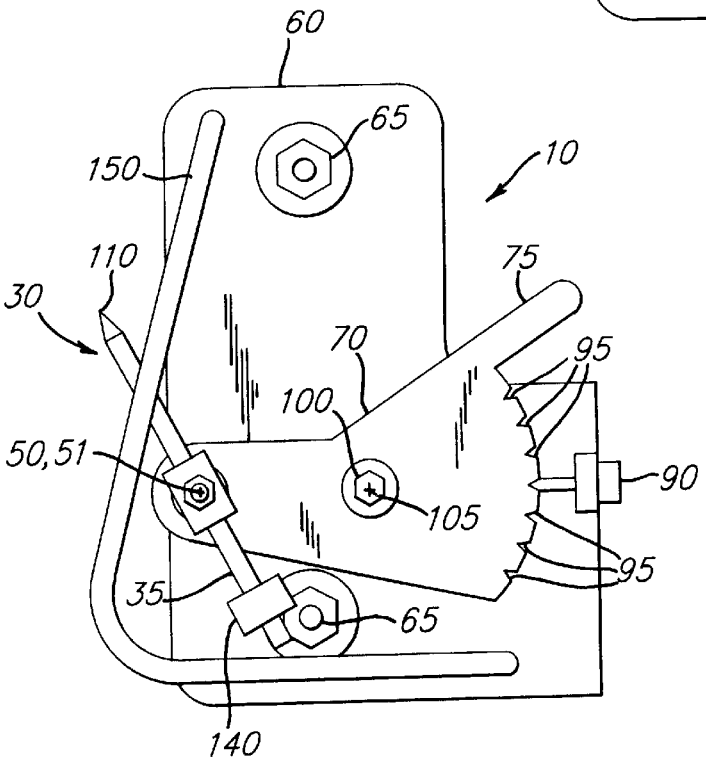
FIG. 1 is a side view of a first embodiment of the instant invention.

An arrow shot downwards from 10 foot high platform at a target at ground level, using a Darton™ 600 WXR Bow with 65 pound pull, a 50% let-off, and a draw length of approximately 28 inches aimed with a single pin fixed that had been calibrated at ground level, struck 10 to 11 inches below the aim point when the sight had been calibrated at 25 yards, and 6 inches below the aim point when the sight had been calibrated at 10 yards. When the fixed pin sight was replaced by a Cobra™ pendulum sight, arrows shot from a 10 foot high platform landed about 8 to 10 inches low for both ranges. Arrows shot from ground using the pendulum sight that had been calibrated at ground level landed within a 2 to 3 inch grouping (circle of diameter surrounding arrows) about the aim point, for shooting ranges from 10 to 25 yards. With the pendulum sight first calibrated at ground level, then shooting from 10 to 14 feet in elevation with the pivot point of the pendulum sight translated downwards by about 0.285 inches, arrows shot from within 30 yards hit the target within 2 to 3 inch groupings. The same level of accuracy could be achieved when shooting from 14 to 18 foot shooting elevations by translating the pivot point of the pendulum sight downwards by about 0.570 inches, and from a 18 to 22 ft. shooting elevation by translating the pivot point of the pendulum sight downwards by about 0.855 inches.

While a calibrated pendulum sight provides automatic compensation for targets at about the same elevation as the archer and within hunting range, which is typically less than 30 yards, these tests illustrate that the pendulum sight fails to automatically compensate for variations in target elevation. These tests further illustrate that the pendulum sight can provide automatic compensation for targets at various ranges and elevations when the height of the pendulum support is adjusted in accordance with the elevation of an archer relative to the target.

Figure 2:
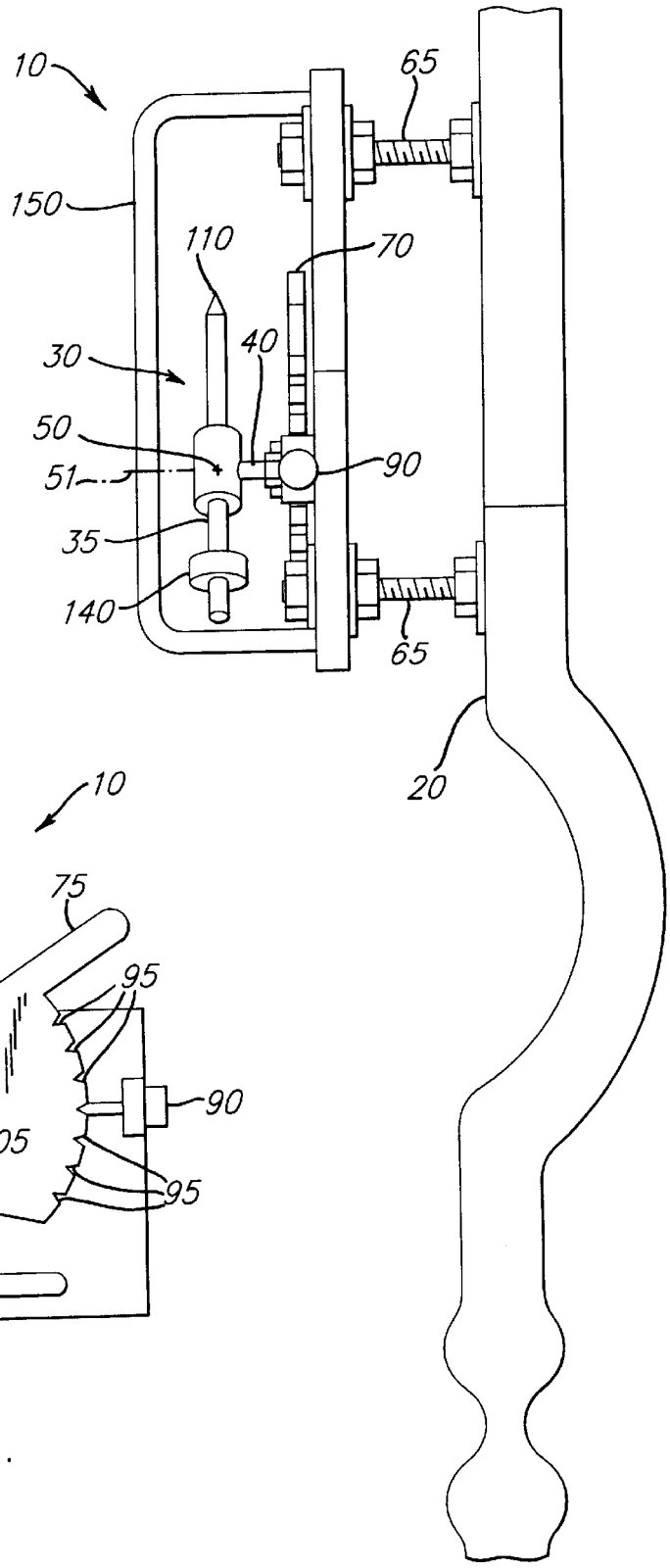
FIG. 2 is a rear view of the first embodiment of the instant invention as seen by the shooter.
Figure 3:
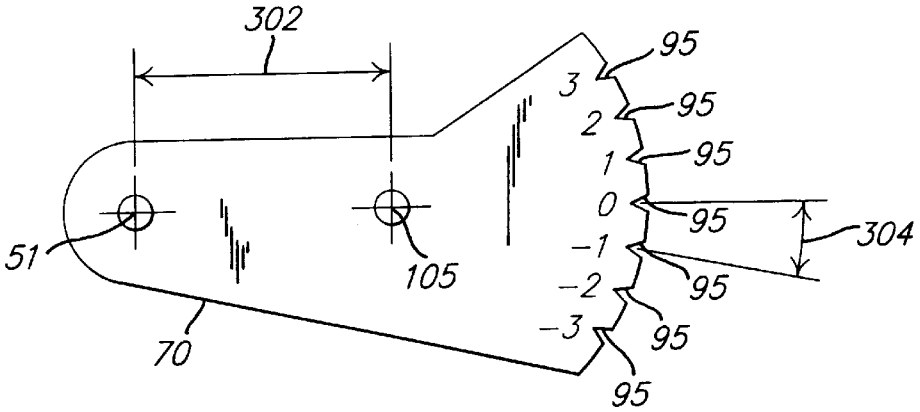
FIG. 3 illustrates an element of a means for moving the pivot point of the pendulum sight subassembly incorporated in the first embodiment of the instant invention.
Figure 4:
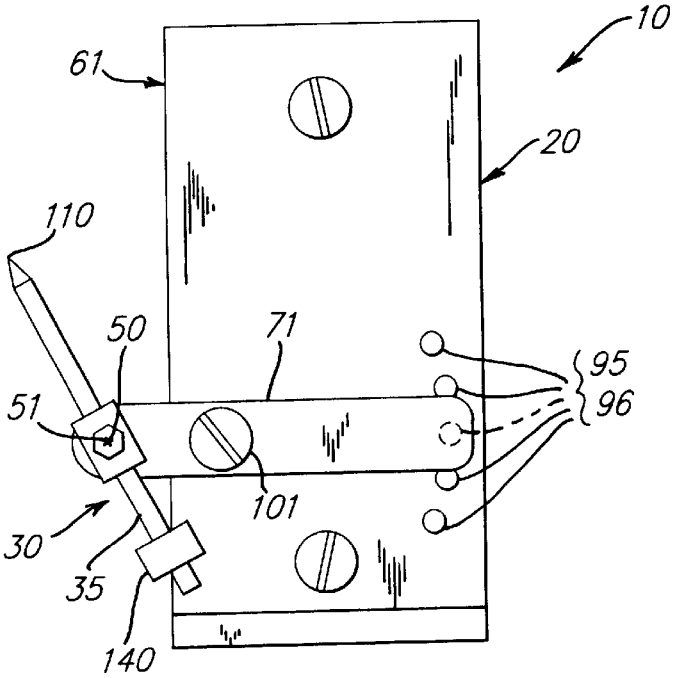
FIG. 4 is a side view of a second embodiment of the instant invention.
Figure 5:
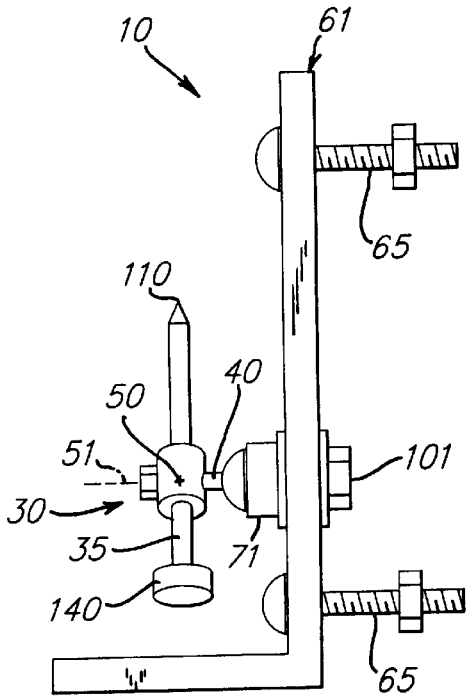
FIG. 5 is a rear view of the second embodiment of the instant invention as seen by the shooter.

Referring to FIGS. 1 and 2, a sight assembly 10 is operatively coupled to an archery bow projectile launcher 20. The sight assembly 10 incorporates a sight assembly attachment 60 which is rigidly attached to the projectile launcher 20 with fasteners 65. A pendulum sight support 70 is pivotally attached to the sight assembly attachment 60 with a fastener 100. A pendulum sight subassembly 30 comprising a pendulum 35 and a pivot shaft 40 about which the pendulum 35 pivots, is operatively coupled to the pendulum sight support 70 with a fastener incorporated in the distal end of the pivot shaft 40. The pendulum 35 has first and second ends and incorporates a counterweight 140 which causes the pendulum to be vertically biased with the first end above the second end by pivoting about a pivot point 50 located on a pivot axis 51 concentric with the pivot shaft 40. The first end of the pendulum 35 incorporates a sight aiming point 110. Referring to FIG. 3, the pivot axis 51 of the pendulum sight subassembly 30 on the pendulum sight support 70 proximate one end of the pendulum sight support 70 is displaced from the pivot axis 105 of the pendulum sight support 70 by a distance 302, and the other end of the pendulum sight support 70 is adapted with an arcuate profile upon which is incorporated a plurality of recesses 95, having an angular separation 304, for cooperation with an indexing mechanism 90 attached to the sight assembly attachment 60. In a preferred mode of operation, the distance 302 is about 0.75 inches, and the angular separation 304 is about 10 degrees. The pendulum sight support 70 is further adapted with a handle 75 for purposes of rotating the pendulum sight support 70 about the pivot axis 105 thereof. A sight guard 150 is attached to the sight assembly attachment 60 to protect the pendulum sight subassembly 30 and the pendulum sight support 70 from disturbance.

Prior to operation of the projectile launcher, the sight assembly 10 is first calibrated at ground level by positioning the pendulum sight support 70 so that recess 95 labeled "0" is aligned with the indexing mechanism 90, and then adjusting the sight assembly attachment 60 so that projectiles launched from projectile launcher 20 aimed with the sight aiming point 110 at a ground level target strike the aim point on the target. The target range for this calibration procedure is selected to be within the expected range of targets during subsequent operation of the projectile launcher, preferably about 15 yards. If the projectile strikes the target above the aiming point, then the sight assembly attachment 60 is raised relative to the projectile launcher 20 by loosening fasteners 65, making the adjustment, for example by moving the sight assembly attachment 60 relative to the fasteners 65 along associated slots (not shown in the drawings, but as known to one of ordinary skill in the art) either in the sight assembly attachment 60 or in an element of the projectile launcher 20 to which the fasteners 65 are attached, and then retightening fasteners 65 without changing the lateral distance between the sight assembly attachment 60 and the projectile launcher 20. If the projectile strikes the target below the aiming point, then the sight assembly attachment 60 is similarly lowered relative to the projectile launcher 20. If the projectile strikes the target left of the aiming point, then the lateral distance between the sight assembly attachment 60 and the projectile launcher 20 is increased by adjusting fasteners 65 without changing the position of the sight assembly attachment 60 along the projectile launcher 20. If the projectile strikes the target right of the aiming point, then the lateral distance between the sight assembly attachment 60 and the projectile launcher 20 is similarly decreased.

After completing the above described ground level calibration of the position of the sight assembly attachment 60, the pendulum sight subassembly 30 is adjusted in accordance with the manufacturer's standard procedure for ground level shooting, for example by sighting-in at a range of 20 yards in accordance with accepted practice.

Then, in the operation of the projectile launcher 20, the angular position of the pendulum sight support 70 is set, using handle 75, in accordance with the elevation of the shooter relative to the target. More particularly, for example, when the shooter is at approximately the same elevation as the target, the pendulum sight support 70 is positioned with the recess 95 labeled "0" aligned with the indexing mechanism 90. For shooting elevations about 10–14 feet above the target, the recess 95 labeled "−1" is aligned with the indexing mechanism 90. For shooting elevations about 14–18 feet above the target, the recess 95 labeled "−2" is aligned with the indexing mechanism 90. For shooting elevations about 18–22 feet above the target, the recess 95 labeled "−3" is aligned with the indexing mechanism 90. For targets located above the shooter by elevations of 10–14 feet, 14–18 feet, or 18–22 feet respectively, the pendulum sight support 70 is correspondingly positioned with the recess 95 labeled "1", "2", or "3" respectively aligned with the indexing mechanism 90. FIG. 1 illustrates the position of the pendulum 35 when aiming at a distant target with is at approximately the same elevation as the shooter.

The accuracy of the operation of the projectile launcher 20 when shooting from elevations differing from the target elevation is further assured by predetermining the proper angular position of the pendulum sight support 70 for given shooting conditions. For example, by shooting from a tree stand or elevated position at a target having a range of about 15 to 20 yards, the angular position of the pendulum sight support 70 is set to position "−1" or "−2" for accurate projectile placement on the target, and then the setting so determined is subsequently utilized when shooting in similar conditions in the field where the target is below the shooter. Similarly, by shooting uphill or at an elevated target at a range of about 15 to 20 yards, the angular position of the pendulum sight support 70 is set to position "1" or "2" for accurate projectile placement on the target, and then the setting so determined is subsequently utilized when shooting in similar conditions in the field where the target is above the shooter.

Referring to FIGS. 4 through 7 illustrating an alternate embodiment of the instant invention, a sight assembly 10 is operatively coupled to an archery bow projectile launcher 20. The sight assembly 10 incorporates a sight assembly attachment 61 which is rigidly attached to the projectile launcher 20 with fasteners 65. A pendulum sight support 71 is pivotally attached to the sight assembly attachment 61 with a fastener 101. A pendulum sight subassembly 30 comprising a pendulum 35 and a pivot shaft 40 about which the pendulum 35 pivots, is operatively coupled to the pendulum sight support 70 with a fastener incorporated in the distal end of the pivot shaft 40. The pendulum 35 has first and second ends and incorporates a counterweight 140 which causes the pendulum to be vertically biased with the first end above the second end by pivoting about a pivot point 50 located on a pivot axis 51 concentric with the pivot shaft 40. The first end of the pendulum 35 incorporates a sight aiming point 110.

Figure 6:
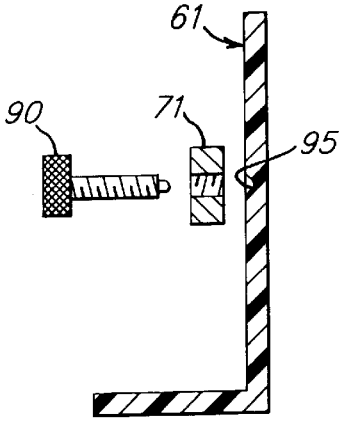
FIG. 6 illustrates an indexing mechanism as applied to the second embodiment of the instant invention.

Referring to FIG. 6, an indexing mechanism 90 attached to pendulum sight support 71 cooperates with indexing slots, grooves, holes, or depressions 95 in sight assembly attachment 61 to provide for indexing the position of the pendulum sight support 71 at discrete angular locations relative to the sight assembly attachment 61.

Figure 7:
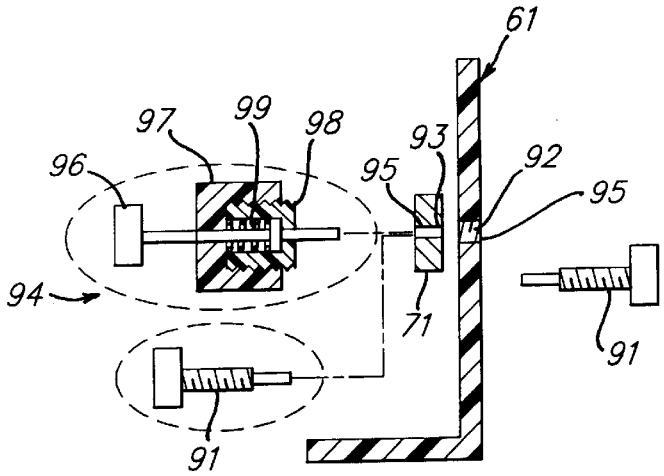
FIG. 7 illustrates an alternate indexing mechanism as applied to the second embodiment of the instant invention.

Referring to FIG. 7, the position of the pendulum sight support 71 may alternately be indexed at discrete angular locations relative to the sight assembly attachment 61 using either an indexing pin 91, which is adapted to either fasten to a threaded hole 93 in the pendulum sight support 71 and engage with one of a plurality of indexing slots, grooves, holes, or depressions 95 in the sight assembly attachment 61 or to fasten at one of a plurality of threaded holes 92 on the sight assembly attachment 61 and engage with an indexing slot, groove, hole, or depression 95 in the pendulum sight support 71. Alternately, the angular position of the pendulum sight support 71 relative to the sight assembly attachment 61 may be indexed with a retractable indexing mechanism 94 comprising an indexing pin 96 slidably engaged with and captivated by a sleeve 98 and cap 97 assembly which attaches to a threaded hole 93 in the pendulum sight support 71, further comprising a spring 99 for biasing the indexing pin 96 into engagement with one of a plurality of indexing slots, grooves, holes, or depressions 95.

Figure 8:
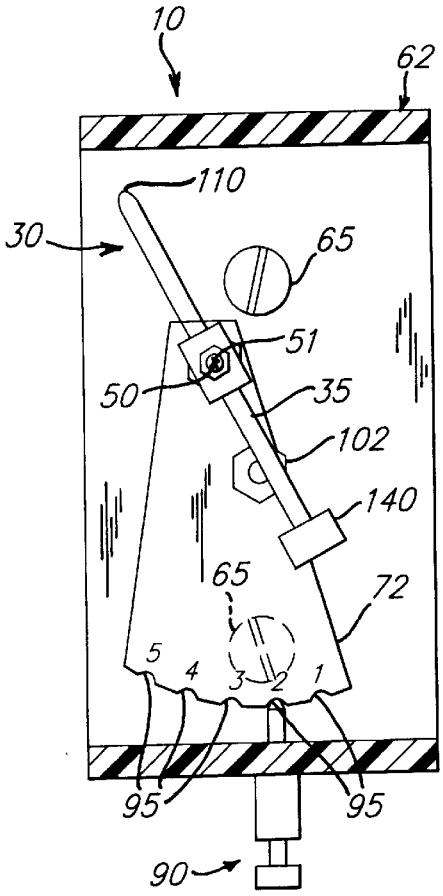
FIG. 8 is a partial side view of a third embodiment of the instant invention.
Figure 9:
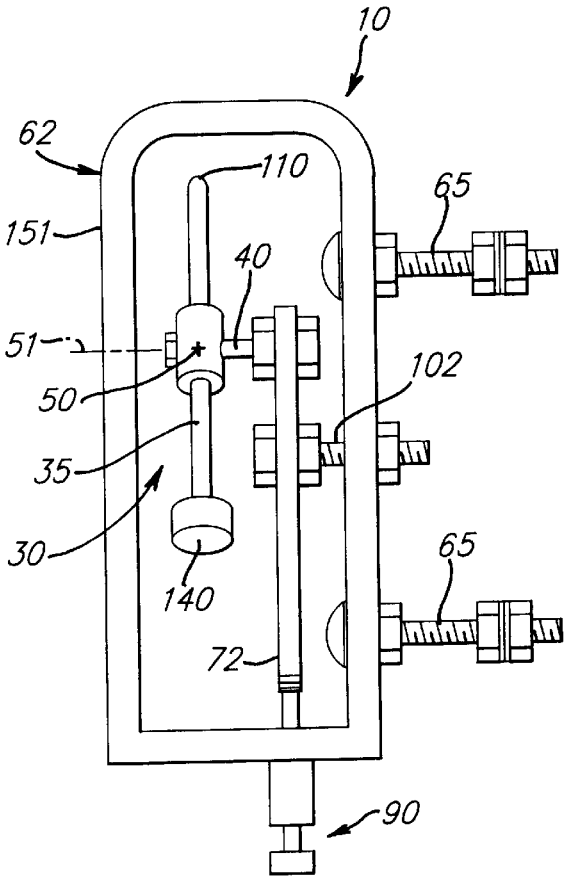
FIG. 9 is a rear view of the third embodiment of the instant invention as seen by the shooter.

Referring to FIGS. 8 and 9, a sight assembly 10 incorporates a sight assembly attachment 62 which is rigidly attached to a projectile launcher 20 with fasteners 65. A pendulum sight support 72 is pivotally attached to the sight assembly attachment 62 with a fastener 102. A pendulum sight subassembly 30 comprising a pendulum 35 and a pivot shaft 40 about which the pendulum 35 pivots, is operatively coupled to the pendulum sight support 72 with a fastener incorporated in the distal end of the pivot shaft 40. The pendulum 35 has first and second ends and incorporates a counterweight 140 which causes the pendulum to be vertically biased with the first end above the second end by pivoting about a pivot point 50 located on a pivot axis 51 concentric with the pivot shaft 40. The first end of the pendulum 35 incorporates a sight aiming point 110. The position of the pendulum sight support 72 is indexed at discrete angular locations relative to the sight assembly attachment 62 by an indexing mechanism 90 which cooperates with indexing slots, grooves, or depressions 95 incorporated into the periphery of the pendulum sight support 72. The sight assembly attachment 62 incorporates a sight guard 151 that protects the pendulum sight subassembly 30 and the pendulum sight support 70 from disturbance.

The instant invention comprises the combination of a pendulum sight with a mechanism for adjusting the height of the pendulum support in accordance with the elevation of the archer relative to the target. The instant invention also comprises the method of sighting a projectile launcher by adjusting the height of a pendulum support in accordance with the elevation of the archer relative to the target, and then sighting on the target using the sight aiming point of the associated pendulum sight.

One of ordinary skill in the art will appreciate that while the instant invention has been illustrated in the environment of an archery bow, that the teachings thereof are applicable to other projectile launchers, particularly those for which the prior art teaches the use of a pendulum sight for purposes of aiming the projectile launcher.

One of ordinary skill in the art will further appreciate that the scope of the instant invention is not limited to the specific type of pendulum sight subassembly, nor to the specific types of mechanisms which enable rapid and precalibrated positioning of the attachment point of the pendulum sight subassembly, as described hereinabove in conjunction with the disclosure of the instant invention. Other types of pendulum sight subassemblies, examples of which are disclosed in the prior art referenced hereinabove and incorporated by reference herein, may be incorporated without departing from the scope of the instant invention. Moreover, other types of mechanisms for positioning a sight attachment point, examples of which are also disclosed in the prior art referenced hereinabove and incorporated by reference herein, may also be incorporated without departing from the scope of the instant invention.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

I claim:

1. A sight assembly for a projectile launcher, comprising:

a. a pendulum sight subassembly operatively coupled to said projectile launcher; and b. a calibration element operatively coupled to said projecting launcher, wherein said calibration element comprises an element selected from an indexing mechanism, a positioning mechanism and a position indicator, by which a pivot point of said pendulum sight subassembly is moveable relative to said projectile launcher in accordance with said calibration element, said calibration element defines a plurality of predetermined positions of said pivot point, and different said predetermined positions are adapted for different operating conditions of the projectile launcher.

2. A sight assembly for a projectile launcher, as recited in claim 1, wherein said pendulum sight subassembly further comprises:

a. a pendulum having first and second ends and a pivot point disposed between said first and second ends such that said pendulum is gravitationally biased towards a vertical position with said first end above said second end;

b. a sight aiming point on said pendulum; and c. a pivot shaft operatively coupled to said pendulum pivot point operatively coupling said pendulum sight subassembly to the projectile launcher.

3. A sight assembly for a projectile launcher, comprising:

a. a pendulum sight subassembly operatively coupled to said projectile launcher; and b. a means for moving a pivot point of said pendulum sight subassembly relative to said projectile launcher in accordance with a calibration.

4. A sight assembly for a projectile launcher, as recited in claim 3, wherein said pendulum sight subassembly further comprises:

a. a pendulum having first and second ends and a pivot point disposed between said first and second ends such that said pendulum is gravitationally biased towards a vertical position with said first end above said second end;

b. a sight aiming point on said pendulum; and c. a pivot shaft operatively coupled to said pendulum pivot point operatively coupling said pendulum sight subassembly to the projectile launcher.

5. A sight assembly for a projectile launcher, comprising:

a. a sight assembly attachment operatively coupled to the projectile launcher;

b. a pendulum sight support operatively coupled to said sight assembly attachment wherein the position of said pendulum sight support is adjustable relative to said sight assembly attachment in accordance with a predetermined calibration; and c. a pendulum sight subassembly operatively coupled to said pendulum sight support.

6. A sight assembly for a projectile launcher, as recited in claim 5, wherein said pendulum sight subassembly further comprises:

a. a pendulum having first and second ends and a pivot point disposed between said first and second ends such that said pendulum is gravitationally biased towards a vertical position with said first end above said second end;

b. a sight aiming point on said pendulum; and c. a pivot shaft operatively coupled to said pendulum pivot point operatively coupling said pendulum sight subassembly to said pendulum sight support.

7. A sight assembly for a projectile launcher, as recited in claim 5, wherein said pendulum sight support is adjustable in accordance with a plurality of predetermined positions.

8. A sight assembly for a projectile launcher, as recited in claim 6, wherein said pendulum sight support is adjustable in accordance with a plurality of predetermined positions.

9. A sight assembly for a projectile launcher, as recited in claim 7, wherein the position of said pendulum sight support is located by an indexing mechanism.

10. A sight assembly for a projectile launcher, as recited in claim 8, wherein the position of said pendulum sight support is located by an indexing mechanism.

11. A sight assembly for a projectile launcher, as recited in claim 5, wherein said pendulum sight support is pivotally attached to said sight assembly attachment and further comprises an indexing mechanism for holding said pendulum sight support at predefined pivotal positions relative to said sight assembly attachment.

12. A sight assembly for a projectile launcher, as recited in claim 6, wherein said pendulum sight support is pivotally attached to said sight assembly attachment and further comprises an indexing mechanism for holding said pendulum sight support at predefined pivotal positions relative to said sight assembly attachment.

13. A sight assembly for a projectile launcher, comprising:

a. A pendulum sight support operatively coupled to the projectile launcher wherein the position of said pendulum sight support is adjustable relative to the projectile launcher in accordance with a predetermined calibration; and b. a pendulum sight subassembly operatively coupled to said pendulum sight support.

14. A sight assembly for a projectile launcher, as recited in claim 13, wherein said pendulum sight subassembly further comprises:

a. a pendulum having first and second ends and a pivot point disposed between said first and second ends such that said pendulum is gravitationally biased towards a vertical position with said first end above said second end;

b. a sight aiming point on said pendulum; and c. a pivot shaft operatively coupled to said pendulum pivot point operatively coupling said pendulum sight subassembly to said pendulum sight support.

15. A sight assembly for a projectile launcher, as recited in claim 13, wherein said pendulum sight support is adjustable in accordance with a plurality of predetermined positions.

16. A sight assembly for a projectile launcher, as recited in claim 14, wherein said pendulum sight support is adjustable in accordance with a plurality of predetermined positions.

17. A sight assembly for a projectile launcher, as recited in claim 15, wherein the position of said pendulum sight support is located by an indexing mechanism.

18. A sight assembly for a projectile launcher, as recited in claim 16, wherein the position of said pendulum sight support is located by an indexing mechanism.

19. A sight assembly for a projectile launcher, as recited in claim 13, wherein said pendulum sight support is pivotally attached to said projectile launcher and further comprises an indexing mechanism for holding said pendulum sight support at predefined pivotal positions relative to said projectile launcher.

20. A sight assembly for a projectile launcher, as recited in claim 14, wherein said pendulum sight support is pivotally attached to said projectile launcher and further comprises an indexing mechanism for holding said pendulum sight support at predefined pivotal positions relative to said projectile launcher.

21. A method of sighting a projectile launcher to launch a projectile at a target, comprising:

a. adjusting the position of a pivot point of a pendulum sight subassembly relative to the projectile launcher in accordance with a calibration; and b. aiming the projectile launcher using a sight aiming point of said pendulum sight subassembly.

22. A method of sighting a projectile launcher to launch a projectile at a target, as recited in claim 21, wherein said pendulum sight subassembly further comprises:

a. a pendulum having first and second ends and a pivot point disposed between said first and second ends such that said pendulum is gravitationally biased towards a vertical position with said first end above said second end;

b. a sight aiming point on said pendulum; and c. a pendulum pivot operatively coupled to said pendulum pivot point operatively coupling said pendulum sight subassembly to the projectile launcher.

23. A method of sighting a projectile launcher to launch a projectile at a target, as recited in claim 21, wherein the position of the pivot point of said pendulum sight subassembly is moved in a plane of rotation of said pendulum sight subassembly in a direction transverse to an aiming direction.

24. A method of sighting a projectile launcher to launch a projectile at a target, as recited in claim 22, wherein the position of the pivot point of said pendulum sight subassembly is moved in a plane of rotation of said pendulum sight subassembly in a direction transverse to an aiming direction.

25. A method of sighting a projectile launcher to launch a projectile at a target, as recited in claim 23, wherein the position of the pivot point of said pendulum sight subassembly is adjusted in accordance with the elevation of the projectile launcher relative to the target.

26. A method of sighting a projectile launcher to launch a projectile at a target, as recited in claim 24, wherein the position of the pivot point of said pendulum sight subassembly is adjusted in accordance with the elevation of the projectile launcher relative to the target.

27. A method of sighting a projectile launcher to launch a projectile at a target, as recited in claim 25, wherein the position of the pivot point of said pendulum sight subassembly is biased towards one of a plurality of predetermined locations.

28. A method of sighting a projectile launcher to launch a projectile at a target, as recited in claim 26, wherein the position of the pivot point of said pendulum sight subassembly is biased towards one of a plurality of predetermined locations.

* * * * *